US009669275B2

(12) United States Patent
Sherman

(10) Patent No.: US 9,669,275 B2
(45) Date of Patent: Jun. 6, 2017

(54) DIVOT REPAIR APPARATUS

(71) Applicant: Barry Sherman, Bridgewater, NJ (US)

(72) Inventor: Barry Sherman, Bridgewater, NJ (US)

( * ) Notice: Subject to any disclaimer, the term of this patent is extended or adjusted under 35 U.S.C. 154(b) by 0 days.

(21) Appl. No.: 14/963,494

(22) Filed: Dec. 9, 2015

(65) Prior Publication Data

US 2016/0166899 A1 Jun. 16, 2016

Related U.S. Application Data

(60) Provisional application No. 62/089,977, filed on Dec. 10, 2014.

(51) Int. Cl.
*A63B 57/50* (2015.01)

(52) U.S. Cl.
CPC ..... *A63B 57/50* (2015.10)

(58) Field of Classification Search
CPC ..... A63B 57/50
USPC ..... 222/175, 449, 451; 172/370, 371; 111/95
See application file for complete search history.

(56) References Cited

U.S. PATENT DOCUMENTS 260,373 A * 7/1882 Erwin ..... G01F 11/282 222/175
1,061,057 A * 5/1913 Etheridge ..... A47L 13/30 111/95
1,793,197 A * 2/1931 Speicher ..... A01C 15/02 239/102.1
1,894,157 A * 1/1933 Campbell ..... A01C 15/02 222/474
2,239,464 A * 4/1941 Moger ..... A01M 25/006 222/175
2,599,118 A * 6/1952 McMillan ..... A01C 15/02 111/95
2,707,068 A * 4/1955 Williamson ..... A01M 25/006 222/175
3,260,417 A * 7/1966 Paxson ..... A01C 7/02 111/7.2
5,339,994 A * 8/1994 Nuila ..... A01C 15/02 111/95
5,503,090 A * 4/1996 Guzan ..... A01G 29/00 111/7.2
6,450,268 B1 9/2002 Taylor
6,637,355 B2 * 10/2003 Springs ..... A01B 1/24 111/95
6,659,027 B1 * 12/2003 Garcia ..... A01C 7/02 111/95
7,406,921 B2 * 8/2008 Longo ..... A01C 15/02 111/95
7,735,436 B2 * 6/2010 Modaresi ..... A01C 15/02 111/95
8,640,925 B1 2/2014 Schwegman

* cited by examiner

*Primary Examiner* — Nicholas J Weiss
(74) *Attorney, Agent, or Firm* — Lerner, David, Littenberg, Krumholz & Mentlik, LLP

(57) ABSTRACT

A divot repair apparatus transports and dispenses fill material to fill and repair divots. The repair apparatus includes a hopper for holding the fill material, the hopper being adapted to be worn on the user's back; a conduit for dispensing the fill material from the hopper; and a valve assembly disposed in the conduit for controlling the flow of the fill material from the hopper. An outlet end of the conduit may include a smoothing tool for manipulating the fill material after it has been dispensed.

15 Claims, 16 Drawing Sheets

DIVOT REPAIR APPARATUS

CROSS-REFERENCE TO RELATED APPLICATION

This application claims the benefit of the filing date of U.S. Provisional Application No. 62/089,977, filed on Dec. 10, 2014, the disclosure of which is hereby incorporated by reference herein.

FIELD OF THE INVENTION

The present invention relates to the repair of divots on golf courses, and more particularly to a portable device that enables divots to be repaired quickly and efficiently.

BACKGROUND OF THE INVENTION

In order for a golf club to maintain a safe and high quality course, it is crucial that divots are repaired properly. The term "divot" refers to the small portion of turf that is removed from the fairway when a golfer swings his club at the golf ball. Divots result from a golfer's club coming in contact with the turf.

Proper golf etiquette suggests that golfers repair their divots; however, golfers often do not fill their divots correctly. Therefore, to maintain the quality of the golf course, maintenance workers must traverse the course and repair those divots that have not been repaired properly by golfers. To effect these repairs, maintenance workers typically scoop fill material from a bucket, bend down, and tamp the fill material into the divot. The fill material may include grass seed. If it does not, the repair procedure may then include the application of seed to the repair. Given the remarkable number of divots created on golf courses daily, this process is extremely time consuming and costly. Moreover, it is strenuous for the maintenance workers to repeatedly bend and straighten to make these repairs, resulting in aching backs and other injuries.

There therefore exists a need for an improved apparatus and method for repairing divots on golf courses that enable these repairs to be made more quickly and efficiently, with less strain on the maintenance workers making the repairs.

BRIEF SUMMARY OF THE INVENTION

The present invention addresses these needs.

One embodiment of the present invention is directed to a divot repair apparatus including a hopper for holding a fill material, the hopper being adapted to be removably carried on a user's back; a conduit for dispensing the fill material from the hopper; and a valve mechanism connected to the conduit for controlling the flow of fill material from the hopper.

Another embodiment of the present invention is directed to a divot repair apparatus including a hopper having a fixed shape for holding a fill material, the hopper being adapted to be removably carried on a user's back; a conduit having a first end connected in fluid communication with the hopper, an outlet end, and a flow channel from the first end to the outlet end for dispensing the fill material from the hopper, the conduit being movable in multiple directions relative to the hopper; a valve mechanism connected to the conduit, the valve mechanism including a valve plate movable between a closed position in which the valve plate occludes the flow channel to block the flow of fill material through the conduit and an open position in which the valve plate does not occlude the flow channel, thereby enabling the fill material to flow through the conduit, the conduit having a flexible portion between the hopper and the valve mechanism and a rigid portion between the valve mechanism and the outlet end; a valve actuator for moving the valve plate from the closed position to the open position; a biasing member for moving the valve plate from the open position to the closed position; a handle connected to the conduit; and a smoothing tool connected to the outlet end of the conduit, the smoothing tool being adapted to manipulate the fill material after it has been dispensed.

BRIEF DESCRIPTION OF THE DRAWINGS

A more complete appreciation of the subject matter of the present invention and the various advantage thereof can be realized by reference to the following detailed description in which reference is made to the accompanying drawings in which.

DETAILED DESCRIPTION

Although the divot repair apparatus is described herein in connection with the repair of divots in golf courses, it will be appreciated that the divot repair apparatus may be used to repair other occurrences of divots and other turf defects, including in soccer and lacrosse fields, other sports fields, and in general landscaping.

Figure 1:
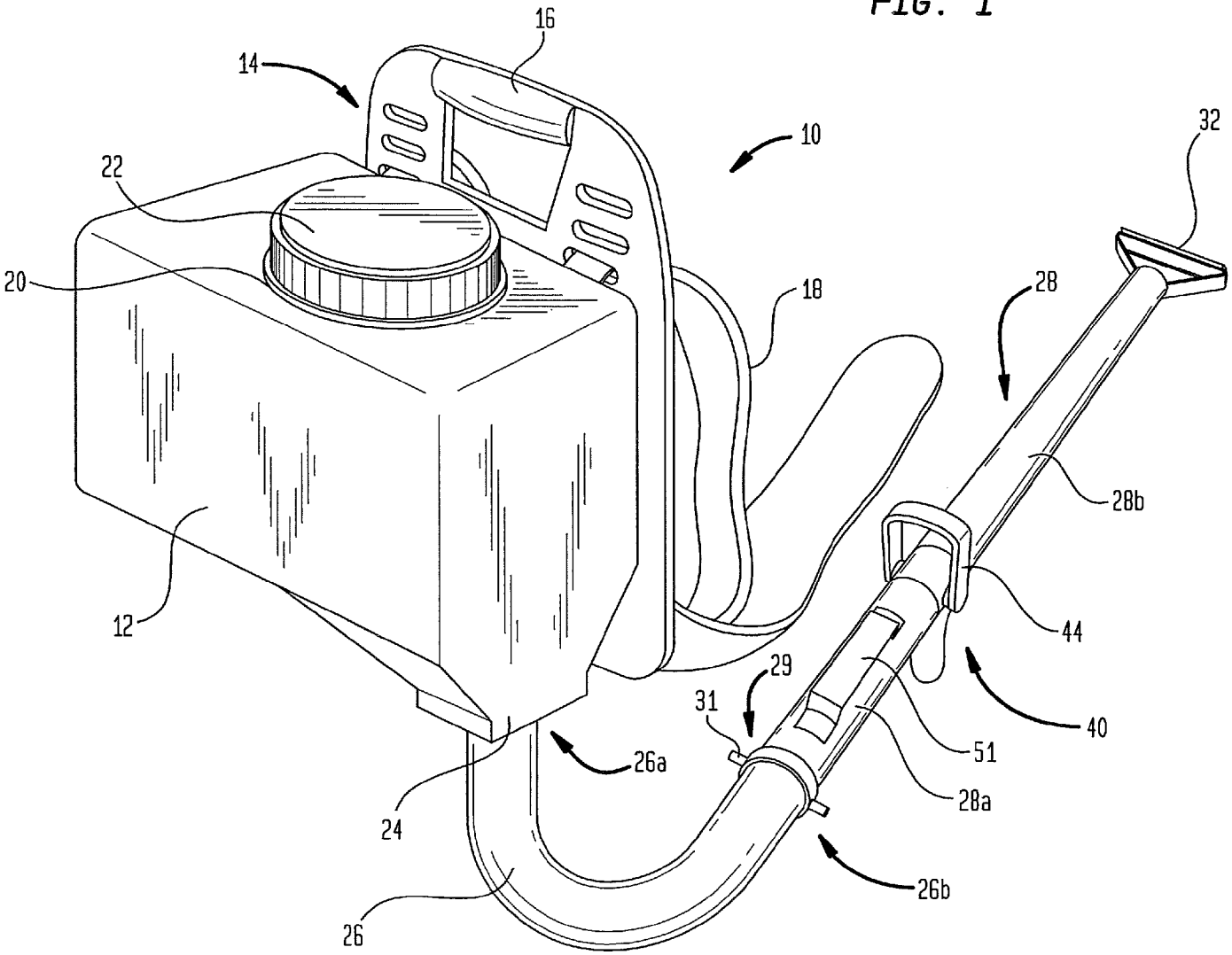
FIG. 1 is a front perspective view of a divot repair apparatus in accordance with one embodiment of the present invention.

A divot repair apparatus 10 according to one embodiment of the present invention is shown in FIG. 1. Divot repair apparatus 10 includes a hopper 12 for storing the fill material to be applied to repair a divot in a golf course. The fill material may include soil, sand, grass seed, fertilizer, or any combination of the foregoing. A harness 14 connected to hopper 12 incorporates a handle 16 to facilitate the lifting and handling of apparatus 10, as well as a pair of shoulder straps 18 that enable the hopper to be worn on the back of the user in a manner similar to a backpack. Harness 14 may further include an adjustable belt 19 that may be fastened and adjusted about the waist of the user to secure hopper 12 to the user's back. In a preferred arrangement, shoulder straps 18 may also be adjustable to enable the user to adjust the hopper to a comfortable position on his or her back.

The top of hopper 12 has a large opening (not shown) for filling the hopper with the fill material to be discharged and applied. The opening may have an upstanding neck 20 to which a cap 22 may be screwed, snapped or press fit to close the opening.

Figure 2:
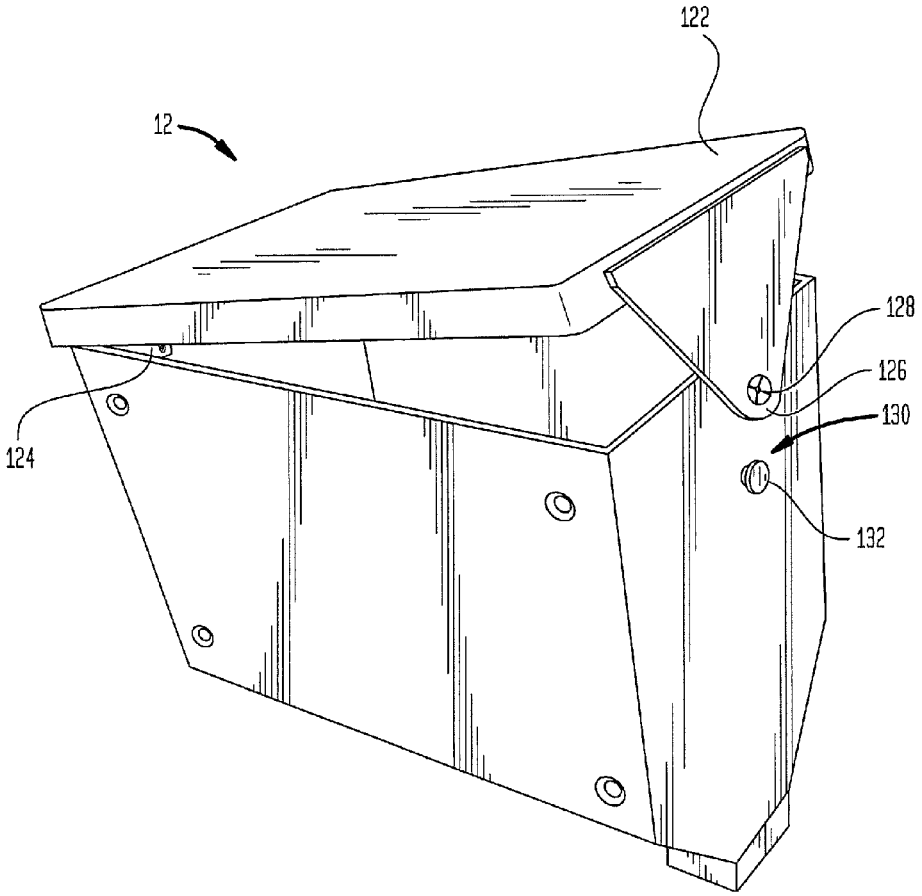
FIG. 2 is a perspective view of an alternate embodiment of a hopper for use with the divot repair apparatus of the present invention.
Figure 3:
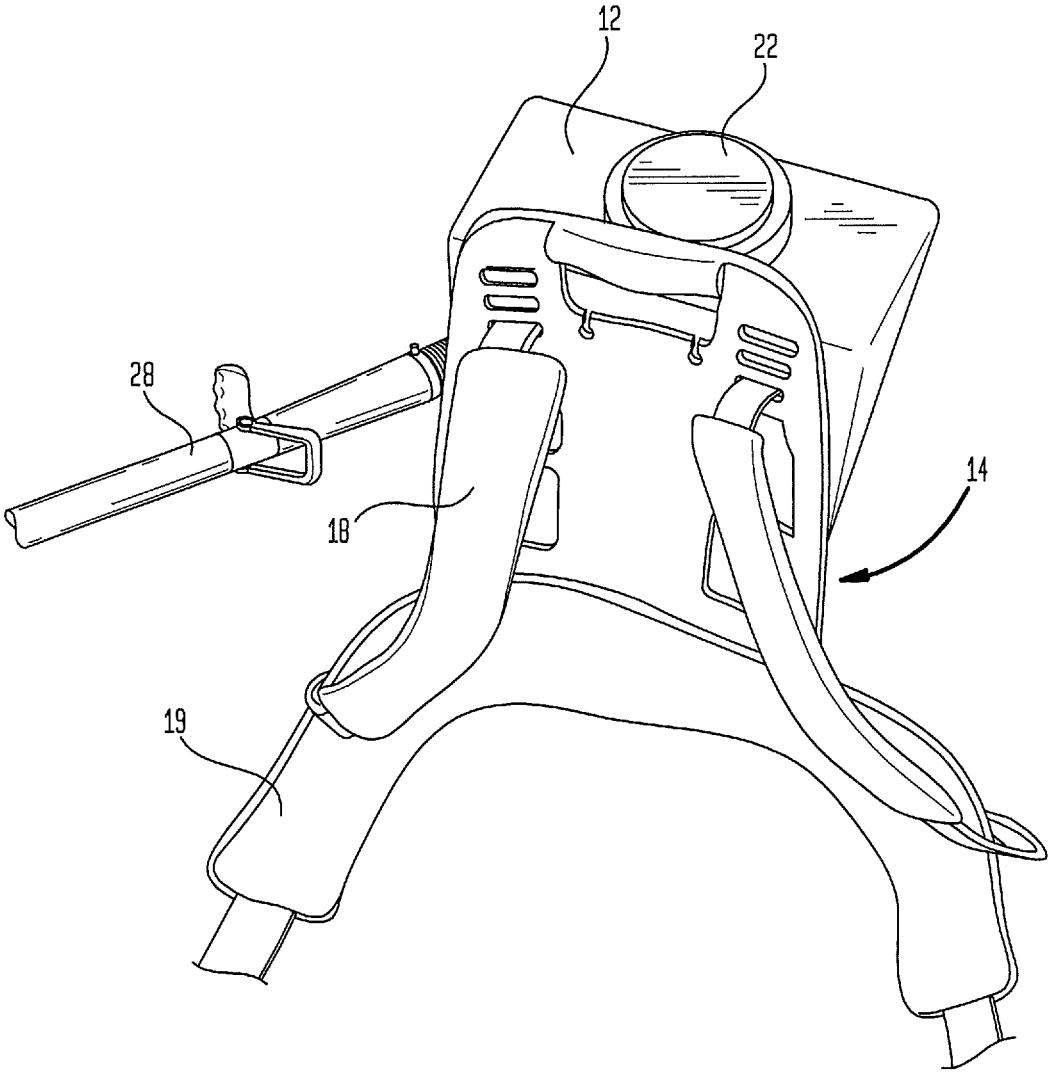
FIG. 3 is a rear perspective view of the divot repair apparatus of FIG. 1.

In an alternate arrangement, the entire top of hopper 12 may be removable from the hopper or may be pivotable to an open position to fill the hopper with the fill material. An example of such arrangement is shown in FIG. 2. In the illustrated example, the entire top of hopper 12 is open, and a lid 122 is pivotably attached to one end of the hopper by a hinge 124. A plurality of conventional latches or other suitable fasteners may be provided to secure the top of the hopper in a closed position. One such fastener is a pliable tab 126 having an aperture 128 that securely fits over a post 130 on the side of hopper 12, post 130 having an enlarged head 132 to hold tab 126 in an assembled condition thereon. Hopper 12 is preferably sized to hold a sufficient quantity of fill material to repair a multiplicity of divots without being too heavy for the user to wear on his or her back.

Hopper 12 preferably has a bottom that tapers downwardly toward an outlet aperture 24 sized to permit the free flow of the dispensed material from the hopper. The downward tapering of the hopper bottom directs the fill material toward outlet aperture 24. A length of flexible hose 26 is connected at one end 26*a* to outlet aperture 24. Hose 26 may be any type of hose that is flexible, sufficiently strong to withstand the flow of fill material over time, and that is preferably kink-free and crush resistant. One example of such hose is an accordion type of hose conventionally used with vacuum cleaners. One method of connecting flexible hose 26 to hopper 12 is to provide a threaded neck (not shown) around outlet aperture 24 of the hopper, and the end 26*a* of flexible hose 26 with a flange (not shown) and a threaded collar 27 fitted over the flange. Threadedly engaging collar 27 to the threaded neck at the outlet of hopper 12 removably secures hose 26 to the hopper. The present invention is not limited to the foregoing mechanism for securing hose 26 to hopper 12, and any mechanism for making this connection is contemplated herein.

Figure 6:
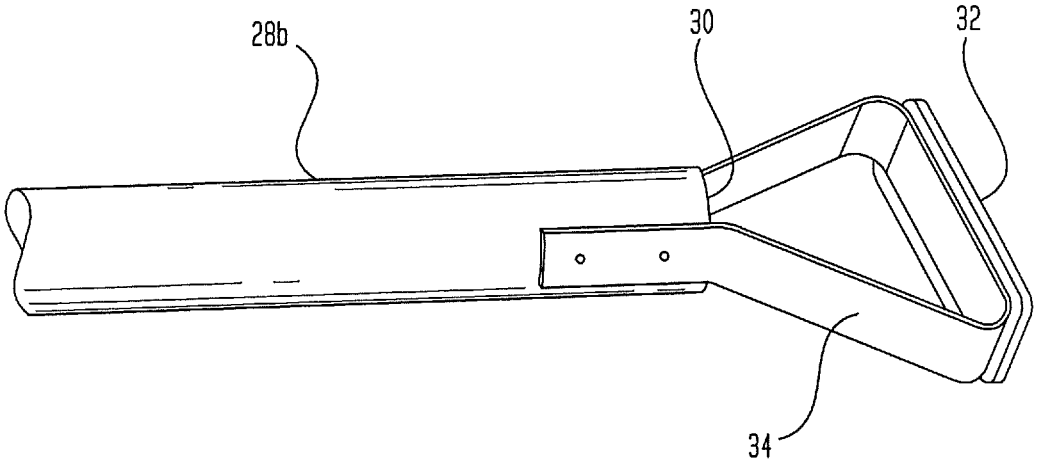
FIG. 6 is an enlarged perspective view of the smoothing tool of the divot repair apparatus of FIG. 1.

The other end 26*b* of hose 26 is connected to a dispensing tube 28. Dispensing tube 28 may be a rigid length of tube formed from a durable polymer or a lightweight metal, such as aluminum. The end 29 of dispensing tube 28 may be threaded, and the end 26*b* of hose 26 may include a flange (not shown) and a threaded coupling 31 for threadedly assembling the hose to the dispensing tube. At its free end 30, dispensing tube 28 is open to provide an outlet for dispensing the fill material from hopper 12. Dispensing tube 28 may include a smoothing tool 32, such as a hoe, rake or other device for tamping, compacting, leveling and smoothing the fill material after it has been applied to the divot. A bracket 34 connected near the free end 30 of dispensing tube 28 may secure smoothing tool 32 at a spaced distance from the dispensing tube outlet so as to not interfere with the flow of the fill material from the dispensing tube, all of which is shown in FIG. 6. Other embodiments of smoothing tools and their connection to dispensing tube 28 are contemplated herein, as will become clear from the description below.

In order to control the flow of fill material from dispensing tube 28, repair apparatus 10 may include a valve assembly 40 between outlet aperture 24 and the free end 30 of dispensing tube 28. Valve assembly 40 may be interposed in an intermediate section of dispensing tube 28 so as to provide a secure connection that can withstand the repeated operation of the valve therein. More particularly, dispensing tube 28 may be divided into two portions a first portion 28*a* disposed between hose 26 and valve assembly 40, and a second portion 28*b* disposed between valve assembly 40 and the free end 30 of the dispensing tube. In some embodiments, portion 28*a* of dispensing tube 28 may gradually taper from a larger diameter at end 29 connected to hose 26, to a smaller diameter where portion 28*a* connects to valve assembly 40.

Valve assembly 40 has a generally cylindrical body 41 that may be connected to portions 28*a* and 28*b* of dispensing tube 28 in a variety of ways. For example, valve assembly 40 may have internal or external threads (or internal threads at one end of body 41 and external threads at the other end of the body) that engage threads at the ends of portions 28*a* and 28*b* of the dispensing tube. Alternatively, the ends of dispensing tube portions 28*a* and 28*b* may be assembled within recesses or over bosses at the ends of valve body 41, and the assembly may be secured by adhesive, ultrasonic welding, screws, rivets, other fasteners and the like. A large passageway 41*a* through body 41 allows fill material to flow through valve assembly 40 from portion 28*a* of the dispensing tube to portion 28*b* thereof.

Figure 4:
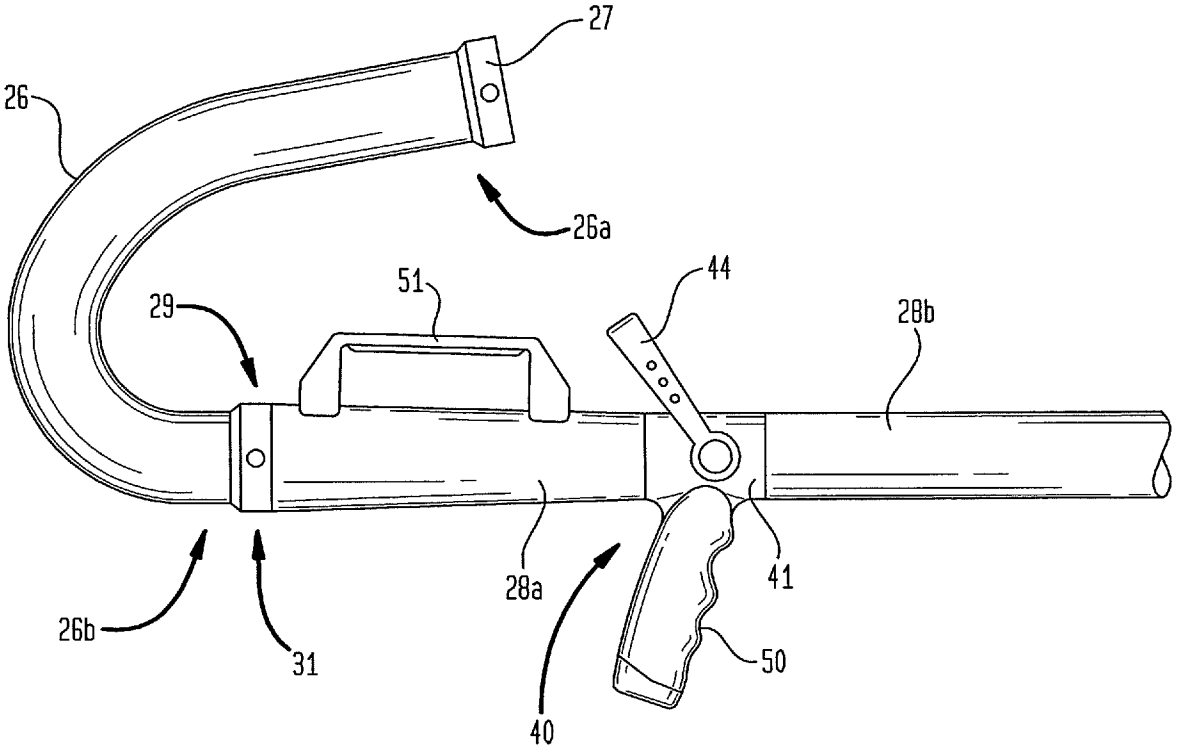
FIG. 4 is an enlarged side view of the handle/valve assembly of the divot repair apparatus of FIG. 1.
Figure 5:
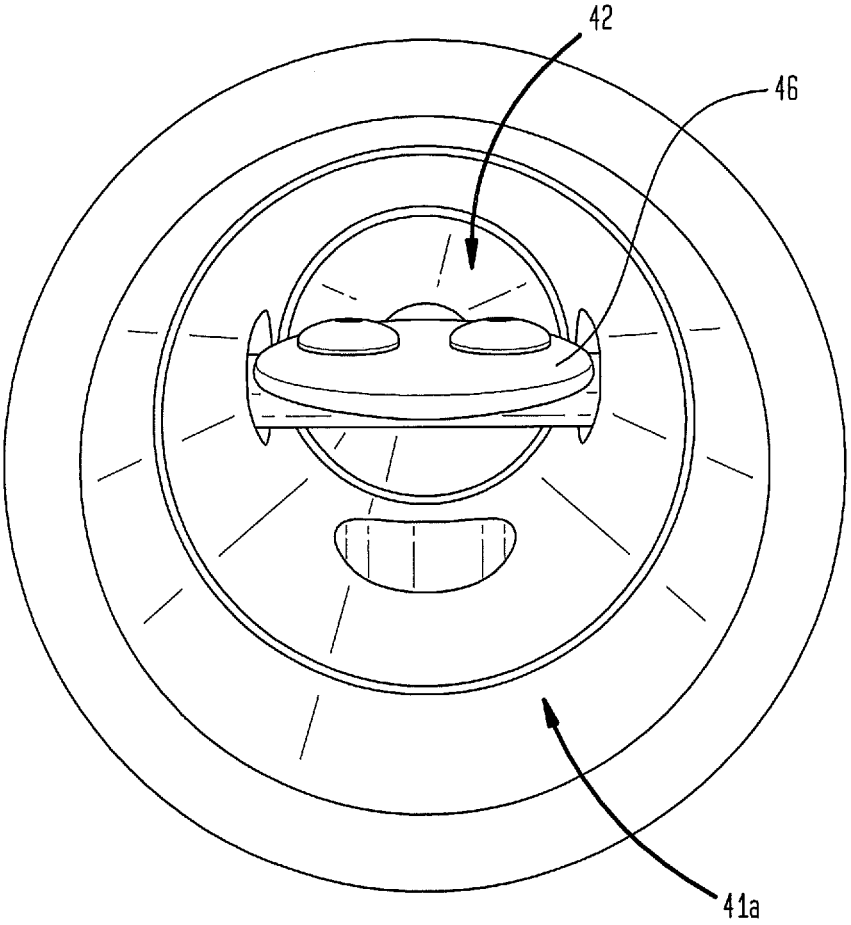
FIG. 5 is a transverse cross-sectional view through the dispensing tube and showing the valve therein in an open position.

Valve assembly 40 may include any form of valve that can be manually or automatically operated by the user to control the dispensing of the fill material. In one embodiment, valve assembly 40 may include a conventional butterfly valve 42 as shown in FIG. 5. Butterfly valve 42 may be operated by a lever 44 pivotably mounted to the outside of valve body 41. Lever 44 is fixedly connected to a generally circular valve plate 46 so that, with lever 44 in the forwardmost position (not shown), butterfly valve 42 will be in the open position shown in FIG. 5, with valve plate 46 substantially parallel to the longitudinal axis of dispensing tube 28, thereby enabling the fill material to flow through valve assembly 40. Moving lever 44 to the rearward position shown in FIG. 4 causes valve plate 46 to move to a position substantially transverse to the longitudinal axis of dispensing tube 28. Valve plate 46 is sized so that, in this transverse position, it occludes passageway 41*a*, closing butterfly valve 42 and stopping the flow of fill material through valve assembly 40. The rate of flow of the fill material through valve assembly 40 can be controlled to some extent by moving lever 44 to a position intermediate the forwardmost and rearwardmost positions so as to partially open butterfly valve 42 until a desired flow rate is achieved. A pistol grip handle 50 may be assembled to dispensing tube 28 to facilitate maneuvering of the dispensing tube as the fill material is being dispensed. For ease of use, handle 50 is preferably connected to valve body 41 so as to be near lever 44. A second handle 51 may be provided on the top of portion 28*a* of dispensing tube 28 to facilitate carrying the dispensing tube from one repair site to the next.

Figures 7A, 7B, 7C:
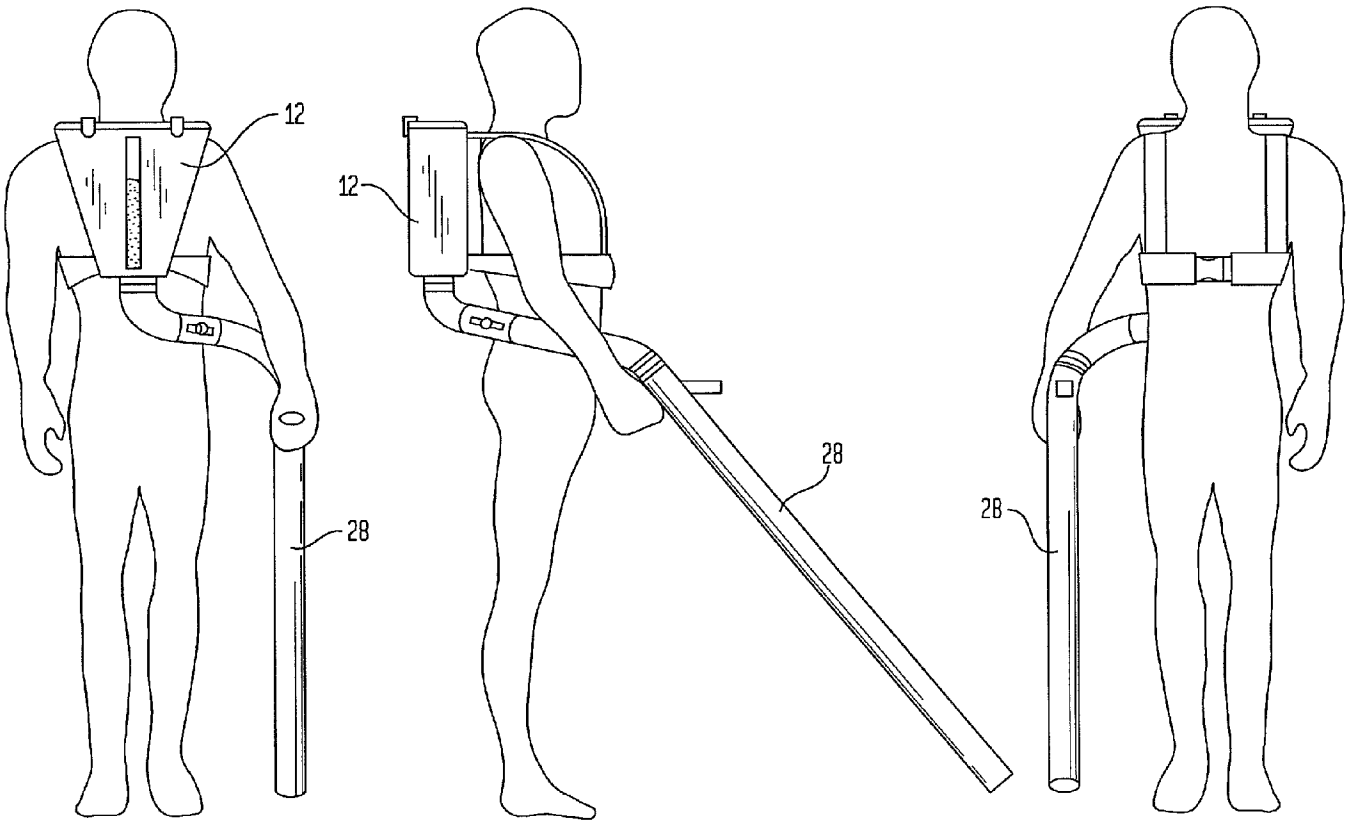
FIGS. 7A-C are highly schematic rear, side and front views showing the divot repair apparatus of FIG. 1 as worn by an individual.
Figure 8:
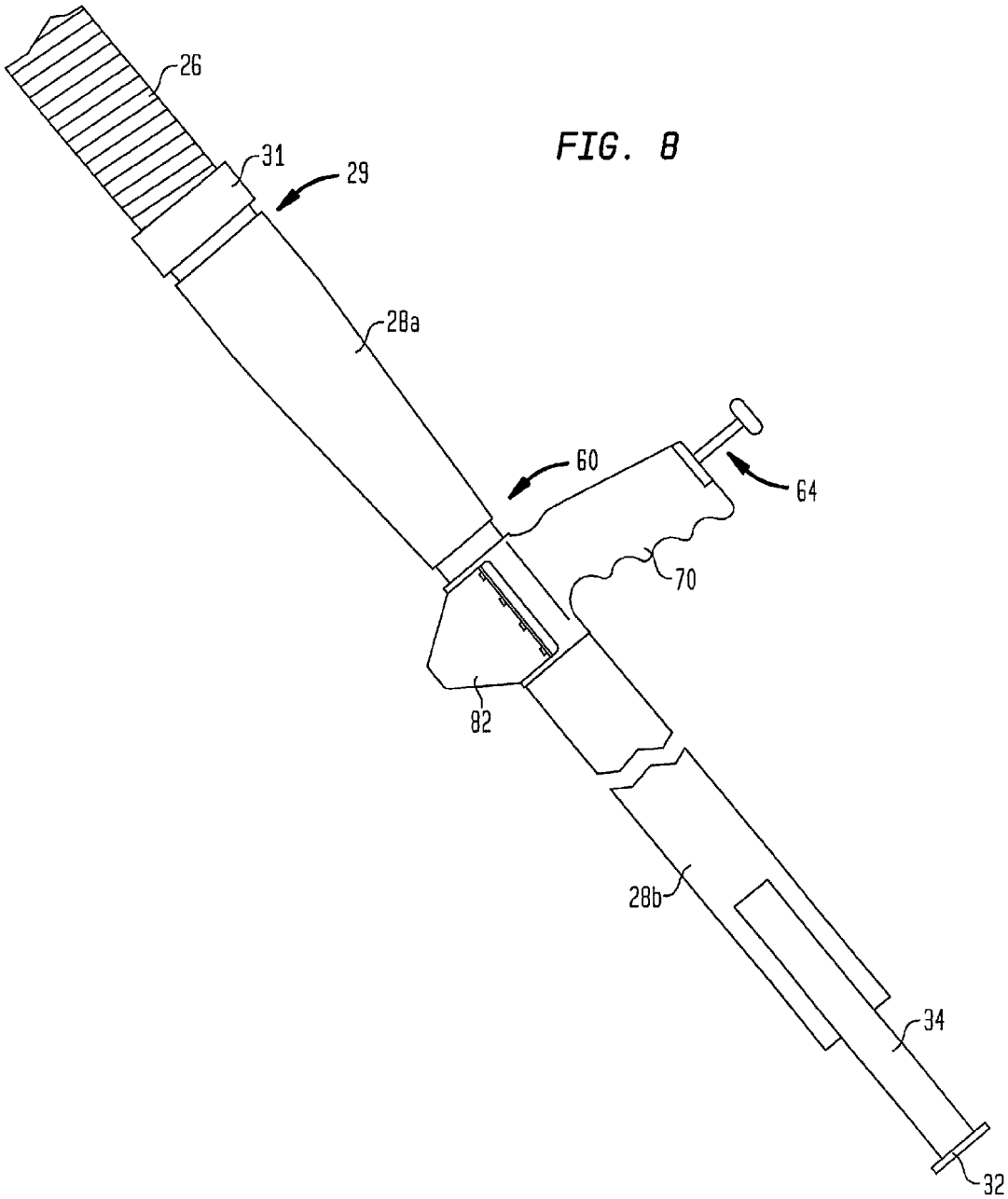
FIG. 8 is an enlarged side view of the handle/valve assembly and dispensing tube of a divot repair apparatus in accordance with another embodiment of the present invention.
Figure 9:
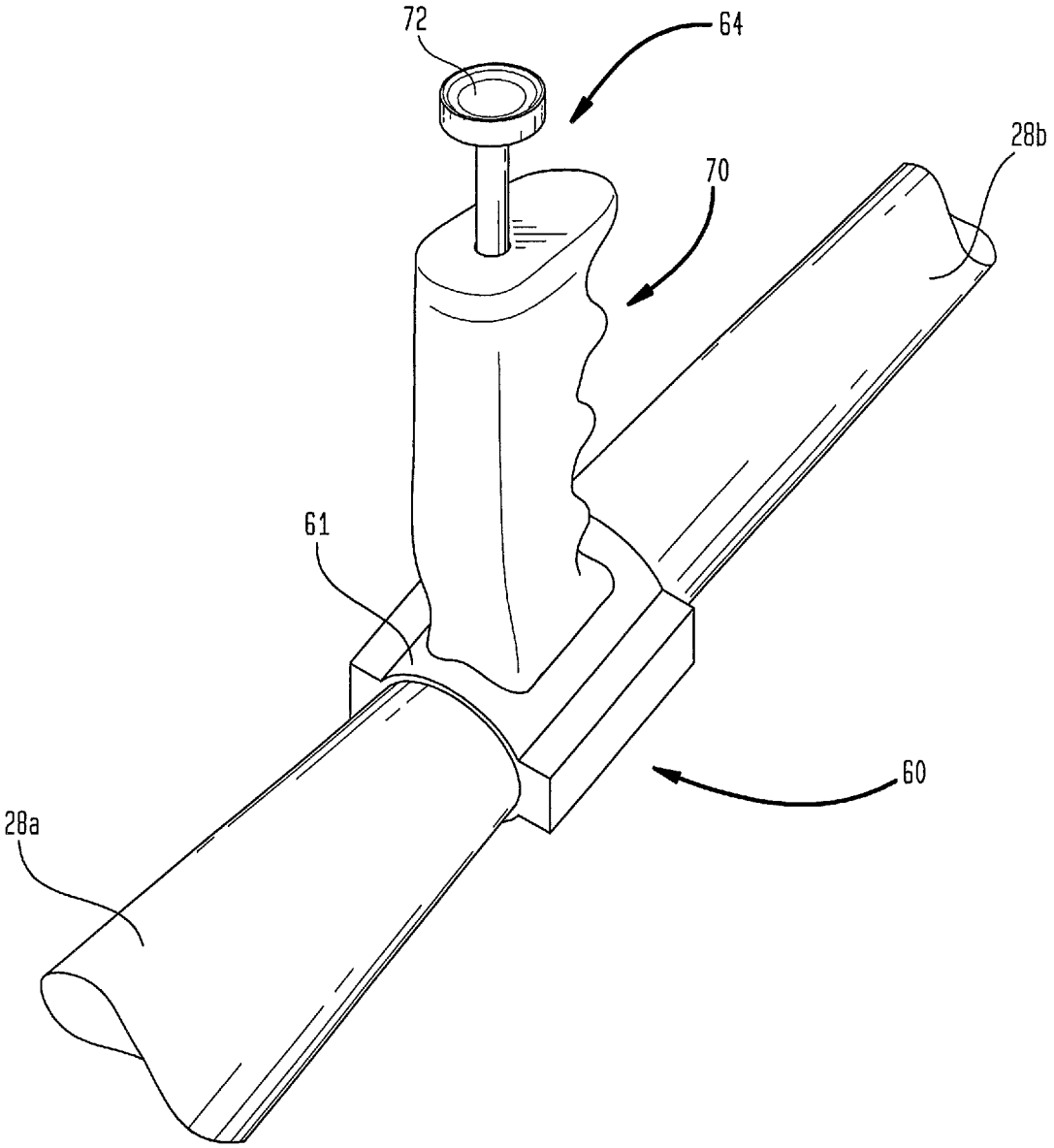
FIG. 9 is an enlarged perspective view of the handle/valve assembly of the divot repair apparatus of FIG. 8.
Figure 10A:
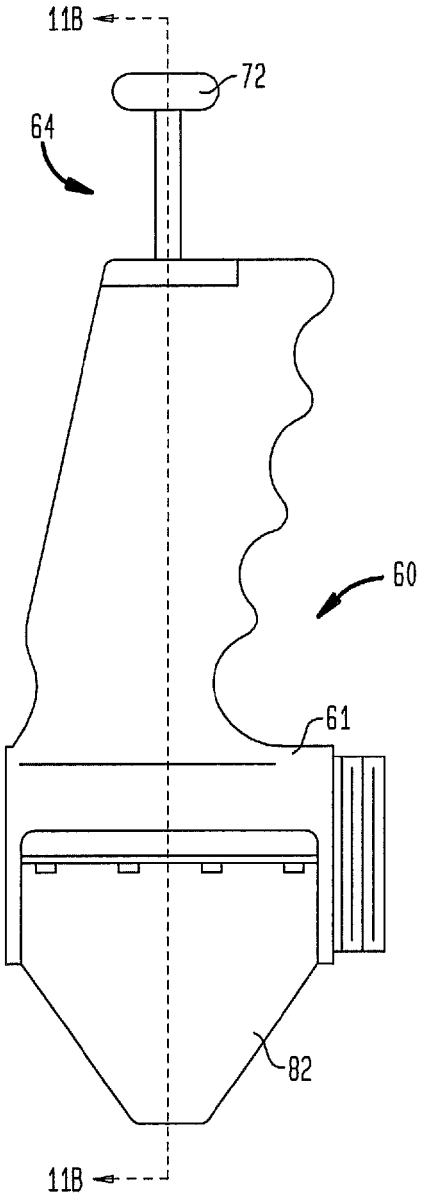
FIGS. 10A-10B are side elevational and front elevational views, respectively, of the handle/valve assembly shown in FIG. 9.
Figure 10B:
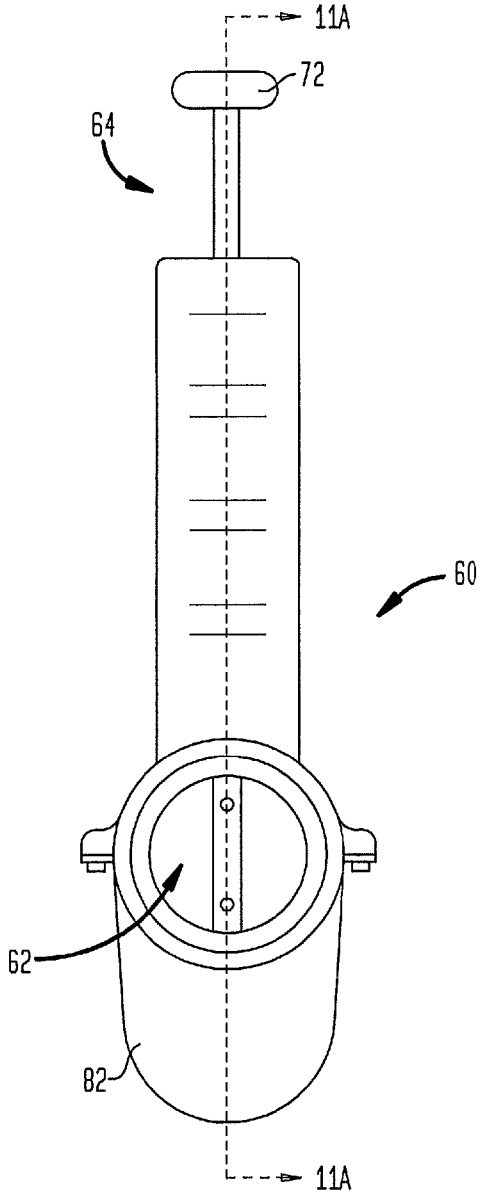

To use repair apparatus 10 to fill divots on golf courses or in other turf areas, the user first fills hopper 12 with an appropriate fill material. The user then places his or her arms through shoulder straps 18 in order to mount hopper 12 on his or her back, as shown in the highly schematic illustrations of FIGS. 7A-C, and closes belt 19 around his or her waist. The user may then grasp handle 50 to maneuver dispensing tube 28 to a position at which its free end 30 overlies a divot to be repaired. While holding handle 50 securely with one hand, the user may use his or her free hand to operate lever 44 to at least partially open butterfly valve 42 so as to commence the flow of the fill material into the divot. For relatively large or deep divots, the user may move valve 42 closer to the fully open position to quickly dispense a relatively large amount of the fill material. For smaller or more shallow divots, on the other hand, the user may open valve 42 to a lesser extent to more slowly and controllably dispense a smaller amount of the fill material. As the fill material is being dispensed, the user can maneuver the dispensing tube 28 so that the fill material is dispensed into the entire area of the divot. Once a desired amount of the fill material has been dispensed, the operator returns lever 44 fully to the rearward position to close valve 42. Subsequently, the user can use the smoothing tool 32 to tamp, compact, level and smooth the fill material within the divot. The user may then walk or ride to the next divot to be repaired and use repair apparatus 10 in the same manner to make such repair.

Divot repair apparatus 10 may employ a valve mechanism other than butterfly valve 42 described above. In one such variant, shown in FIGS. 8-11B, the valve assembly 60 of the repair apparatus may employ a gate valve 62. As with valve assembly 40, valve assembly 60 may be interposed between portions 28*a* and 28*b* of dispensing tube 28 to provide a secure connection that can withstand the repeated operation of the valve therein. Valve assembly 60 has a generally cylindrical body 61 that may be connected to portions 28*a* and 28*b* of dispensing tube 28 using any of the mechanisms described above. A large passageway 61*a* through body 61 allows the fill material to flow through valve assembly 60 from portion 28*a* of dispensing tube 28 to portion 28*b* thereof.

Figure 11A:
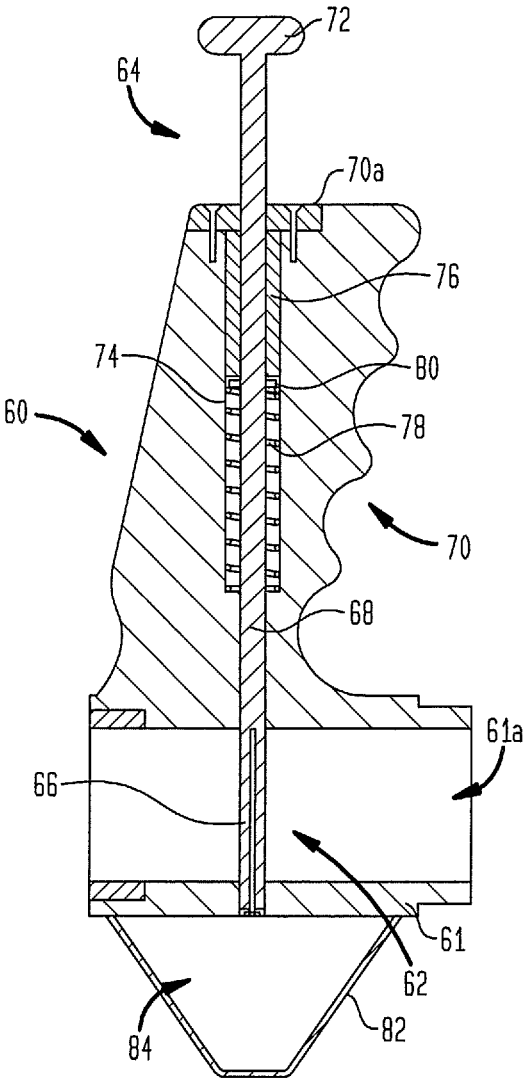
FIG. 11A is a longitudinal cross-sectional view of the handle/valve assembly taken along line A-A of FIG. 10B.
Figure 11B:
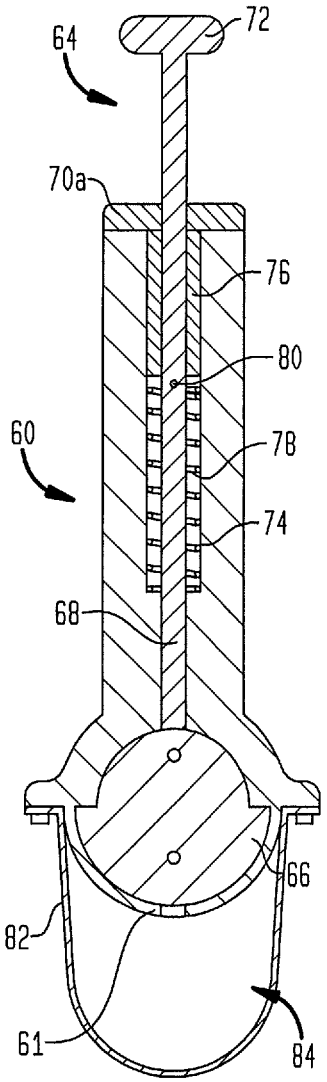
FIG. 11B is a longitudinal cross-sectional view of the handle/valve assembly taken along line B-B of FIG. 10A.

Referring in particular to the cross-sectional views of FIGS. 11A and 11B, the gate valve 62 of valve assembly 60 includes a generally circular valve plate 66 that may be moved between open and closed positions by a plunger 64. Plunger 64 includes an elongated shaft 68 that is slidably disposed in a pistol grip handle 70 projecting from body 61. One end of shaft 68 is fixedly connected to valve plate 66, while the other end includes a button 72 that may be depressed by the user's thumb. To accommodate the sliding movement of shaft 68, handle 70 has an elongated blind bore 74 with a guide bearing 76 press fit in place at its open end. An access plate 70*a* having an aperture to accommodate shaft 68 may be fastened to handle 70 to enclose the open end of bore 74 and keep bearing 76 in place. Bearing 76 guides the movement of shaft 68 and prevents excessive wear of handle 70 on repeated actuation of plunger 64. Preferably, bearing 76 is formed from a different material than shaft 68 to prevent the shaft from binding as it slides through the bearing. A spring 78 is assembled around shaft 68 between bearing 76 and the closed end of bore 74. Spring 78 interacts with a pin 80 connected transversely through shaft 68 such that pin 80 compresses spring 78 when plunger 64 is depressed and, upon release of pressure on plunger 64, the spring bias returns the plunger to its starting position.

Valve assembly 60 may further include an enclosure 82 disposed on the opposite side of valve plate 66 from handle 70. Enclosure 82 defines a cavity 84 having a size sufficient to accommodate the full diameter of valve plate 66 in the open position. That is, as plunger 64 is depressed, valve plate 66 is pushed into cavity 84 and out of the flow path of fill material through channel 61*a*. Since the movement of valve plate 66 relative to body 61 of valve assembly 60 may push some of the fill material into cavity 84, enclosure 82 may be provided with a clean-out aperture (not shown) for emptying any fill material from cavity 84 so as to not interfere with the full movement of valve plate 66. As the pressure on plunger 64 is released, valve plate 66 returns to its starting position within channel 61*a*. Valve plate 66 is sized so that, in this starting position, it occludes channel 61*a*, closing gate valve 62 and terminating the flow of fill material through valve assembly 60. The rate at which the fill material flows through valve assembly 60 can be controlled by the extent to which plunger 64 is depressed. That is, depressing plunger 64 fully causes valve plate 66 to move entirely into cavity 84 and out of the flow path through channel 61*a*, resulting in the maximum flow rate. Depressing plunger 64 only partially, however, will cause a portion of valve plate 66 to remain in channel 61*a* to partially occlude the flow of fill material. Hence, plunger 64 may be depressed by an amount sufficient to achieve a desired flow rate of the fill material.

The use of repair apparatus 10 incorporating valve assembly 60 to fill divots on golf courses or in other turf areas follows substantially the same procedure as described above in connection with repair apparatus 10 incorporating valve assembly 40. That is, after hopper 12 has been filled with fill material and mounted on the user's back, the user may grasp handle 70 to maneuver the outlet of dispensing tube 28 over a divot to be repaired. While grasping handle 70, the user may place his or her thumb on button 72 and depress plunger 64 to at least partially open gate valve 62 so as to commence the flow of the fill material into the divot. The user may depress plunger 64 fully to quickly dispense a relatively large amount of the fill material, or only partially to more slowly and controllably dispense a smaller amount of the fill material. Once a desired amount of the fill material has been dispensed, the user may release plunger 64, whereupon spring 78 returns the plunger and its associated valve plate 66 to the starting position to close gate valve 62 and stop the flow of fill material through dispensing tube 28. Subsequently, the user can use smoothing tool 32 to tamp, compact, level and smooth the fill material within the divot. Additional divots may be repaired using substantially the same technique. Repair apparatus 10 incorporating valve assembly 60 may be operated with only a single hand, rather than the two hands required to operate repair apparatus 10 incorporating valve assembly 40. As a result, repair apparatus 10 incorporating valve assembly 60 is easier to use, and enables repairs to be made more quickly and accurately.

It will be appreciated that, once the valve mechanism in divot repair apparatus 10 is closed, the fill material in dispensing tube 28 downstream of the valve mechanism will continue to flow from the dispensing tube toward the divot being repaired. As the butterfly valve 42 and the gate valve 62 in the embodiments of divot repair apparatus 10 described above are spaced a large distance from the free end 30 of dispensing tube 28, a substantial amount of fill material may flow from the dispensing tube after the valve therein has been closed. This could result in an overfilling of the divot and a waste of fill material. In order to provide a more responsive valve mechanism which minimizes the flow of fill material from dispensing tube 28 after the valve has been closed, it is preferable to locate the valve closer to the free end 30 of the dispensing tube. A variant of divot repair apparatus 10 incorporating such feature is shown in FIGS. 12A-15B. In this variant, the valve mechanism of the divot repair apparatus may employ a gate valve 140 that is similar to gate valve 62. However, gate valve 140 is spaced much closer to the free end 30 of dispensing tube 28 than is gate valve 62. Preferably, gate valve 140 is positioned between about 2 inches and about 15 inches from the free end of the dispensing tube, and more preferably between about 8 inches and about 12 inches from the free end of the dispensing tube. Gate valve 140 may be actuated by a trigger mechanism 150 similar to the mechanism described above for operating gate valve 62. Trigger mechanism 150 has a generally cylindrical body 152 that may be connected between portions 28*a* and 28*b* of dispensing tube 28 using any of the arrangements described previously. A large passageway 152*a* through body 152 allows the fill material to flow through trigger mechanism 150 from portion 28*a* of dispensing tube 28 to portion 28*b* of the dispensing tube.

Figure 14A:
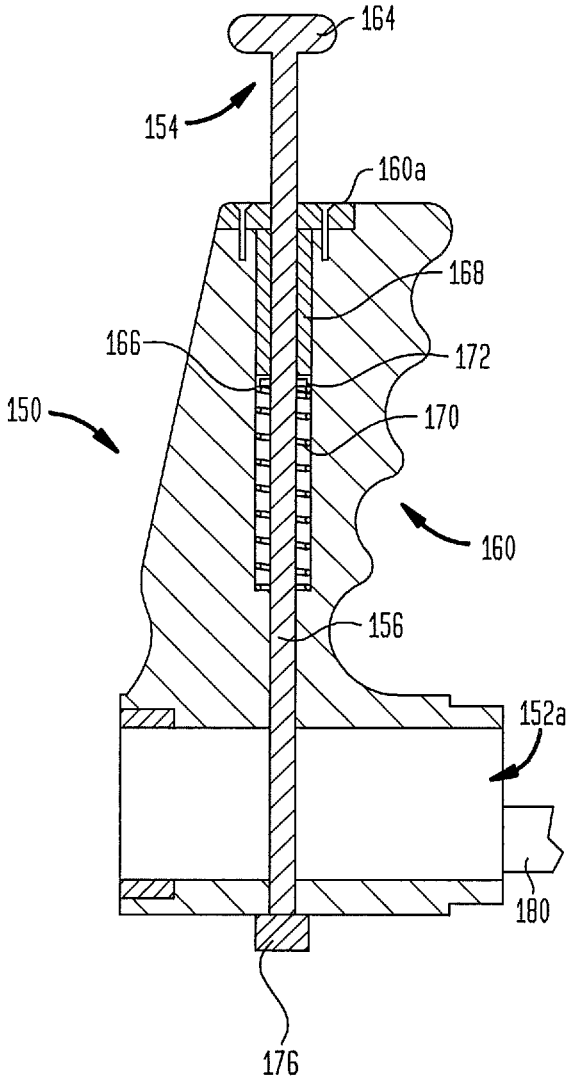
FIG. 14A is a longitudinal cross-sectional view of the trigger mechanism taken along line A-A of FIG. 13B.
Figure 14B:
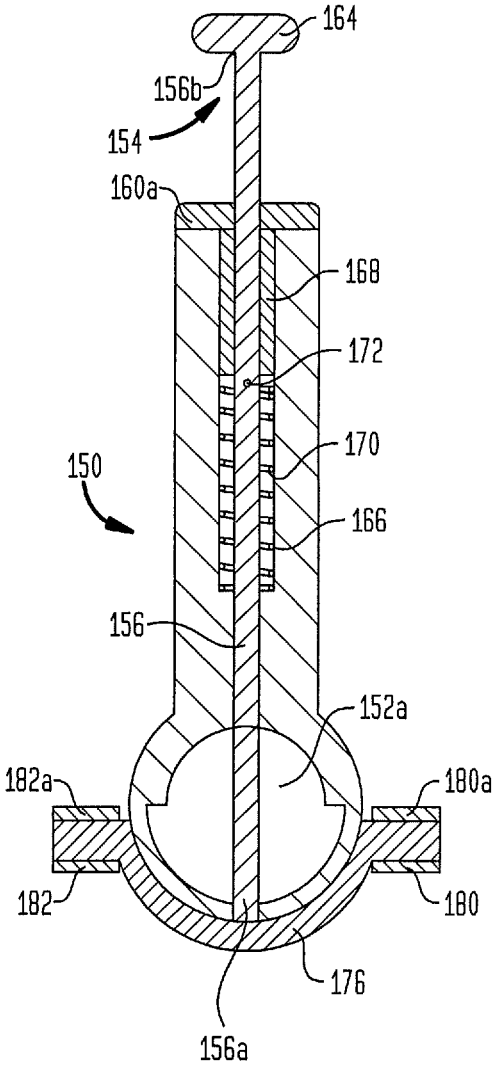
FIG. 14B is a longitudinal cross-sectional view of the trigger mechanism taken along line B-B of FIG. 13A.

Referring to the cross-sectional views of FIGS. 14A and 14B, trigger mechanism 150 includes a plunger 154 having an elongated shaft 156 that is slidably disposed in a pistol grip handle 160 projecting from body 152. One end 156*a* of shaft 156 is connected through a linkage assembly to gate valve 140, as explained further below. The other end 156*b* of shaft 156 includes a button 164 that may be depressed by the user's thumb. To accommodate the sliding movement of shaft 156, handle 160 may have an elongated blind bore 166 with a guide bearing 168 press fit in place at the open end thereof. An access plate 160*a* having an aperture to accommodate shaft 156 may be fastened to handle 160 to enclose the open end of bore 166 and keep bearing 168 in place. Bearing 168 guides the movement of shaft 156 and prevents excessive wear of handle 160 on repeated actuation of plunger 154. Bearing 168 preferably is formed from a different material than shaft 156 to prevent the shaft from binding as it slides through the bearing. A spring 170 may be assembled around shaft 156 between bearing 168 and the closed end of bore 166. Spring 170 may interact with a pin 172 connected transversely through shaft 156 such that pin 172 compresses spring 170 when plunger 154 is depressed and, upon release of pressure on plunger 154, the bias of spring 170 returns the plunger to its starting position.

The linkage assembly operatively connecting shaft 156 to gate valve 140 includes an arcuate bar 176 disposed outside of body 152 and oriented substantially orthogonally to the elongation direction of dispensing tube 28. The curvature of bar 176 follows that of dispensing tube 28 so as to minimize the overall profile of the divot repair apparatus 10. Bar 176 is connected to the end 156*a* of shaft 156 so that, as plunger 154 is depressed, bar 176 moves away from the cylindrical body 152 of trigger mechanism 150, and as plunger 154 is released, bar 176 moves toward and perhaps against body 152. The end 180*a* of a first elongated lever arm 180 is connected to one end of bar 176 and extends along one side of dispensing tube 28 toward the free end 30 thereof, and the end 182*a* of a second lever arm 182 is connected to the other end of bar 176 and extends along the other side of dispensing tube 28 toward the free end 30 thereof. Bar 176 preferably extends far enough along the circumference of body 152 to position lever arms 180 and 182 on opposite sides of dispensing tube 28 and above the bottommost extent of the dispensing tube. Lever arms 180 and 182 are pivotally connected to portion 28*b* of dispensing tube 28 by a pair of coaxially aligned pivot pins 184 (only one of which is visible in FIGS. 12A and 12B). Pivot pins 184 may be journaled in roller bearings or other bearings (not shown) attached on opposite sides of portion 28*b* of dispensing tube 28 to facilitate the pivoting action of lever arms 180 and 182 and minimize wear.

Figure 15A:
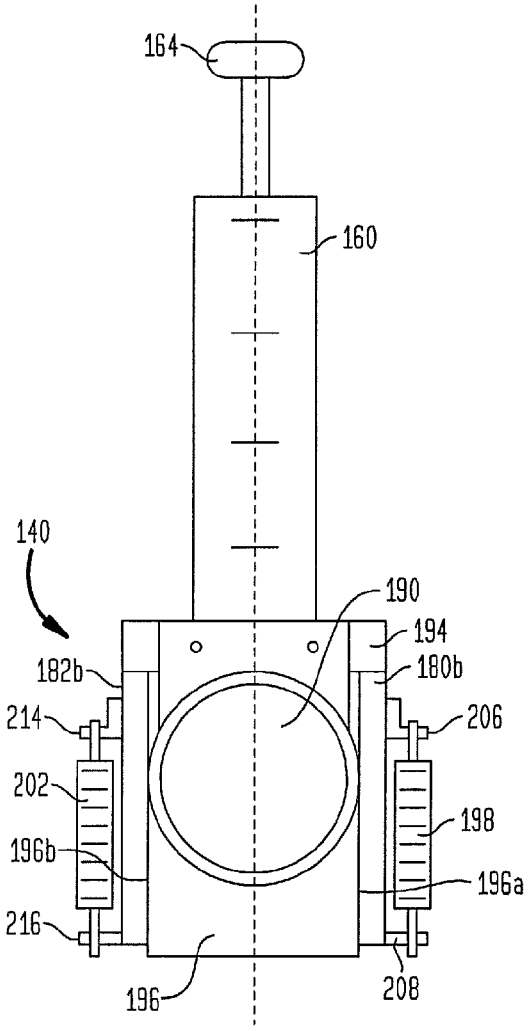
FIG. 15A is a front view of the valve mechanism of the divot repair apparatus of FIG. 12A, showing the valve in a closed position.
Figure 15B:
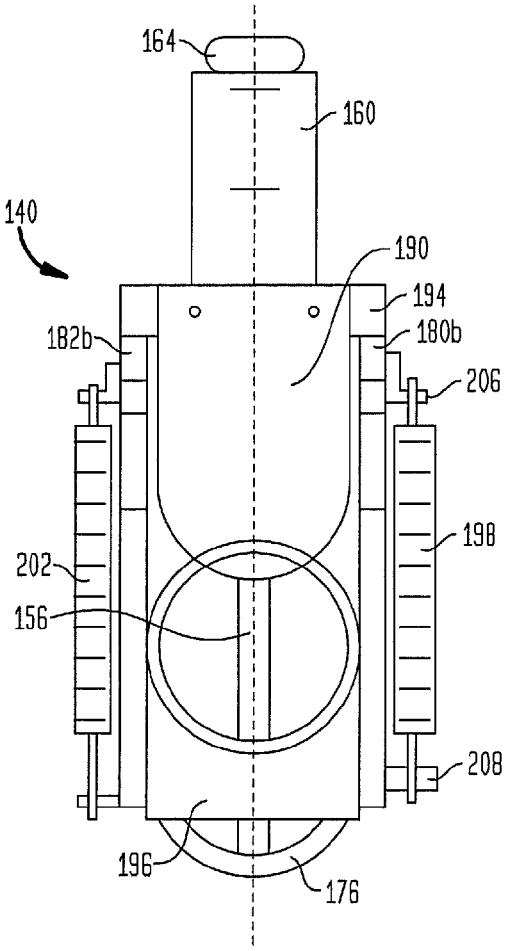
FIG. 15B is a front view of the valve mechanism of the divot repair apparatus of FIG. 12A, showing the valve in an open position.

The opposite ends of lever arms 180 and 182 are operatively connected to the valve mechanism or gate valve 140. Referring to FIGS. 15A and 15B, gate valve 140 includes a valve plate 190 that is slidable between open and closed positions through a slot 192 in portion 28*b* of dispensing tube 28. In order to accommodate the pivoting motion of lever arms 180 and 182, slot 192 may be oriented at a slight angle toward handle 160. Valve plate 190 may be mounted at its top edge to a cross bar 194 connected between the end 180*b* of lever arm 180 and the end 182*b* of lever arm 182. The lever arm ends 180*b* and 182*b* may be vertically offset from the remainder of lever arms 180 and 182, respectively, so as to provide for sufficient travel of valve plate 190 between the open and closed positions.

An anchor block 196 may be mounted to dispensing tube 28 opposite slot 192. Anchor block 196 may serve as an anchor for a series of springs or other biasing members connected to lever arms 180 and 182. More particularly, a first spring 198 may be connected at one end to a bracket 206 joined to the end 180*b* of lever arm 180, and at the opposite end to a boss 208 protruding from side 196*a* of anchor block 196. A second spring 200 may be positioned alongside spring 198 with one end connected to a bracket 210 joined to the end 180*b* of lever arm 180, and the other end connected to a boss 212 protruding from side 196*a* of anchor block 196. A similar arrangement can be found on the opposite side of dispensing tube 28. One spring 202 may be connected at one end to a bracket 214 joined to the end 182*b* of lever arm 182, with the other end attached to a boss 216 protruding from side 196*b* of anchor block 196. Another spring (not shown) may be positioned alongside spring 202, with one end connected to a bracket (not shown) joined to the end 182*b* of lever arm 182, and the other end connected to a boss (not shown) protruding from side 196*b* of anchor block 196. Depending on their stiffness, there may be less than or more than four springs or other biasing members connecting lever arms 180 and 182 to anchor block 196.

Figure 12A:
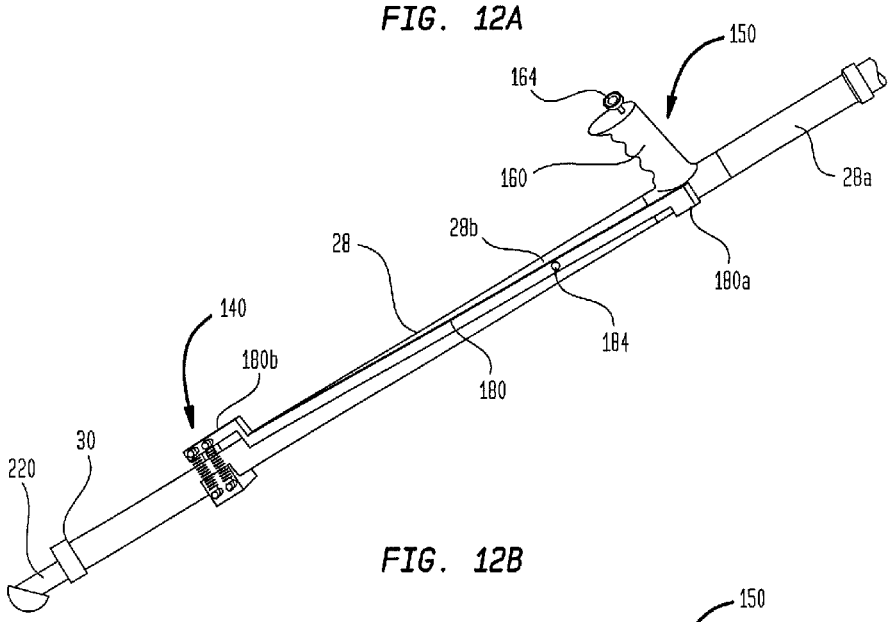
FIG. 12A is a side view of the handle/valve assembly and dispensing tube of a divot repair apparatus in accordance with another embodiment of the present invention, with the valve in a closed position.
Figure 12B:
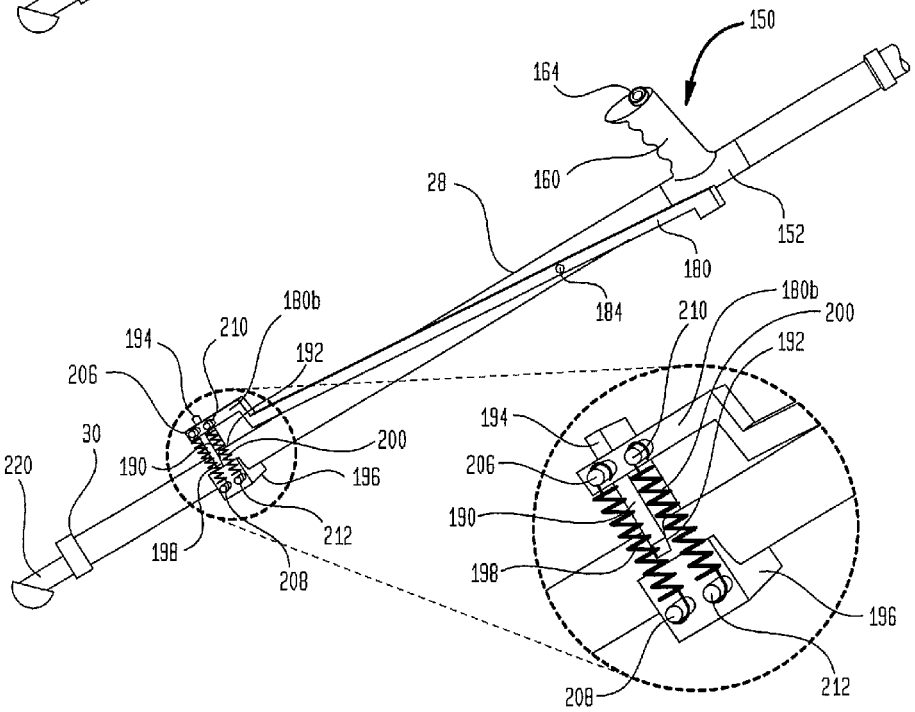
FIG. 12B is a side view of the handle/valve assembly and dispensing tube of the divot repair apparatus shown in FIG. 12A, with the valve in an open position.
Figure 13A:
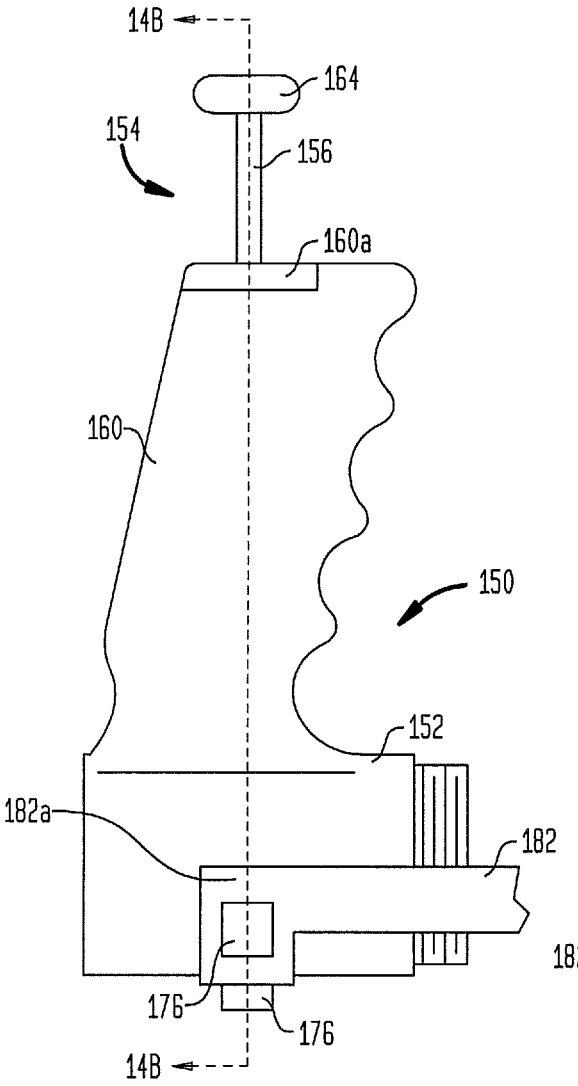
FIGS. 13A-13B are side elevational and front elevational views, respectively, of the trigger mechanism of the divot repair apparatus of FIG. 12A.
Figure 13B:
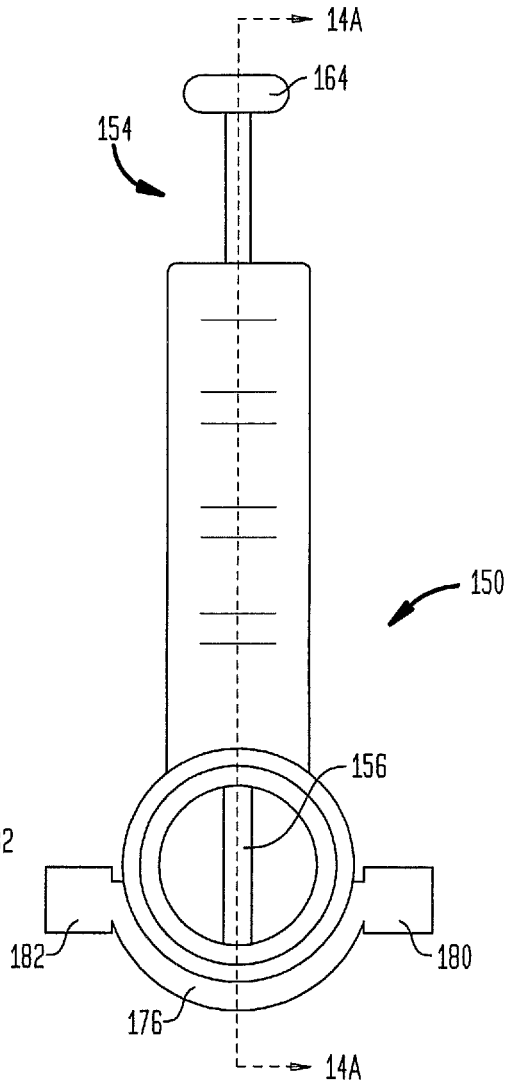

In the operation of this variant of divot repair apparatus 10, depressing plunger 154 causes lever arms 180 and 182 to pivot in the clockwise direction (as viewed in FIGS. 12A and 12B) between the closed position shown in FIG. 12A and the open position shown in FIG. 12B. By positioning pivot pins 184 closer to handle 160 than to gate valve 140, relatively small movements of the ends 180*a* and 182*a*, respectively, of lever arms 180 and 182 result in relatively large movements of the ends 180*b* and 182*b* of the lever arms.

In a variant of this embodiment, divot repair apparatus 10 may include a second slot (not shown) through dispensing tube 28 opposite slot 192. In such variant, valve plate 190 may extend through the second slot in the closed position to assure that flow through dispensing tube 28 is fully occluded. Since the movement of valve plate 190 relative to dispensing tube 28 may push some of the fill material through the second slot, anchor block 196 may define a cavity (not shown) in which such fill material may accumulate. A clean-out aperture (not shown) may be provided on anchor block 196 for emptying any fill material therein so as to not interfere with the full movement of valve plate 190. Anchor block 196 may be connected to dispensing tube 28 on both sides of slot 192 and the second slot to provide structural integrity to the dispensing tube in this region.

Figure 16:
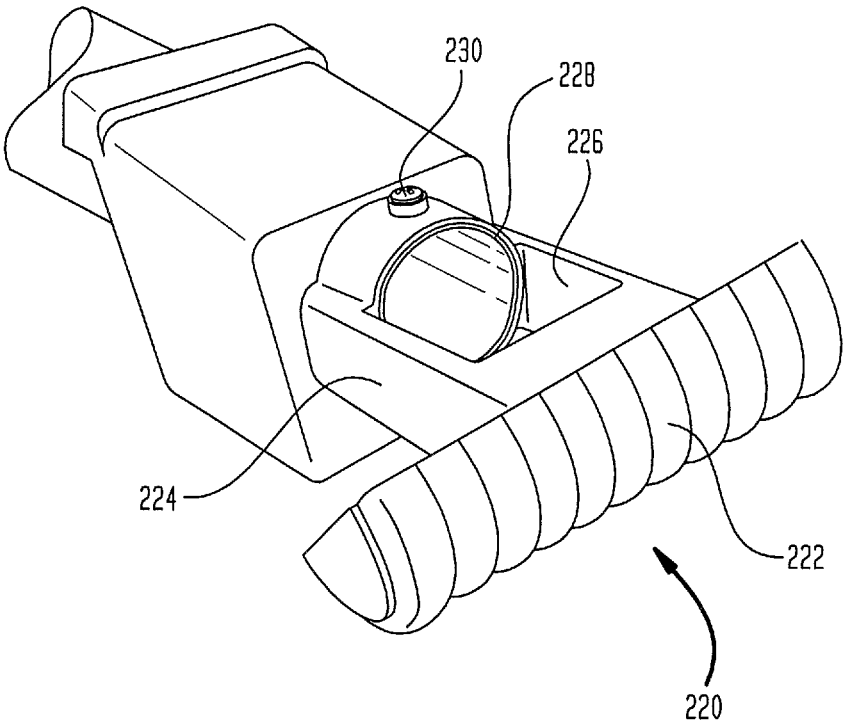
FIG. 16 is a perspective view of an alternate embodiment of a smoothing tool for use with the divot repair apparatus of the present invention.

The free end 30 of dispensing tube 28 may include the smoothing tool 32 described above, or it may include any other type of smoothing tool, including the smoothing tool 220 shown in FIG. 16. Smoothing tool 220 may be molded from a durable polymer, and may include a rake portion 222 having a plurality of rounded ridges arranged alongside one another in a direction traverse to the elongation direction of dispensing tube 28. Rake portion 222 may be connected by a pair of arms 224 and 226 to a ring 228 sized to fit over the free end 30 of dispensing tube 28. One or more fasteners 230 may secure smoothing tool 220 to dispensing tube 28. Arms 224 and 226 have a length sufficient to position rake portion 222 at a spaced distance from the dispensing tube outlet so as to not interfere with the flow of the fill material from the dispensing tube. Smoothing tool 220 may be used with the embodiment of divot repair apparatus 10 shown in FIGS. 12A-15B, or with any of the other embodiments of divot repair apparatus 10 described herein.

A user may use divot repair apparatus 10 having gate valve 140 to fill divots on a golf course or in other turf areas in a manner similar to the method of use described above. After filling hopper 12 with an appropriate fill material and closing the top thereof, the user may mount hopper 12 on his or her back. The user may then grasp handle 160 to maneuver dispensing tube 28 to a position at which its free end 30 overlies a divot to be repaired. While grasping handle 160, the user may depress plunger 154, resulting in a clockwise rotation of lever arms 180 and 182. The rotation of lever arms 180 and 182 in a clockwise direction causes valve plate 190 to move from the closed position shown in FIG. 15A to the open position shown in FIG. 15B against the bias of the springs connecting the lever arms to anchor block 196. The movement of valve plate 190 to the open position commences the flow of the fill material into the divot. The user may depress plunger 154 fully to quickly dispense a relatively large amount of the fill material, or only partially to more slowly and controllably dispense a smaller amount of the fill material. Once a desired amount of the fill material has been dispensed, the user may release plunger 154, at which point the bias of spring 170 returns the plunger to its starting position. The upward movement of plunger 154 causes arcuate bar 176 to move upwardly toward the body 152 of trigger mechanism 150 which, in turn, causes lever arms 180 and 182 to pivot in the counterclockwise direction. At the same time, the bias of the springs connecting lever arms 180 and 182 to anchor block 196 draws valve plate 190 downward toward the closed position, terminating the flow of fill material from dispensing tube 28. The user may subsequently use smoothing tool 220 to tamp, compact, level and smooth the fill material within the divot. Additional divots may be repaired using substantially the same technique. Repair apparatus 10 incorporating gate valve 140 may be operated with only a single hand. Moreover, the proximity of valve plate 190 to the free end 30 of dispensing tube 28 results in only a small amount of fill material flowing from the divot repair apparatus after valve mechanism 140 has been moved to the closed position.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A divot repair apparatus, comprising:

a hopper for holding a fill material, the hopper being adapted to be removably carried on a user's back;

a conduit having a flow channel and an outlet end for dispensing the fill material from the hopper;

a valve mechanism connected to the conduit for controlling the flow of fill material from the hopper, the valve mechanism including:

a valve plate positioned on the conduit at a spaced distance from the outlet end, the valve plate being slidable between a closed position in which the valve plate occludes the flow channel to block the flow of fill material through the conduit and an open position in which the valve plate does not occlude the flow channel, thereby enabling the fill material to flow through the conduit; and a pair of lever arms;

an outlet biasing member positioned at the spaced distance from the outlet end of the conduit, the outlet biasing member being configured to bias the valve plate from the open position to the closed position; and a valve actuator for moving the valve plate from the closed position to the open position, wherein the pair of lever arms are interconnected between the valve actuator and the valve plate, the lever arms being pivotably connected to the conduit to convert movement of the valve actuator to a corresponding movement of the valve plate from the closed position to the open position.

2. The divot repair apparatus as claimed in claim 1, wherein the hopper has a fixed shape.

3. The divot repair apparatus as claimed in claim 1, wherein the conduit has a first end connected in fluid communication with the hopper and the flow channel extends from the first end to the outlet end for dispensing the fill material from the hopper.

4. The divot repair apparatus as claimed in claim 3, wherein the conduit is movable in multiple directions relative to the hopper.

5. The divot repair apparatus as claimed in claim 1, wherein the valve plate is positioned closer to the outlet end of the conduit than to the valve actuator.

6. The divot repair apparatus as claimed in claim 5, wherein the valve plate is positioned between 2 inches and 15 inches from the outlet end of the conduit.

7. The divot repair apparatus as claimed in claim 6, wherein the valve plate is positioned between 8 inches and 12 inches from the outlet end of the conduit.

8. The divot repair apparatus as claimed in claim 1, wherein the conduit has a flexible portion between the hopper and the valve mechanism and a rigid portion between the valve mechanism and the outlet end.

9. The divot repair apparatus as claimed in claim 1, further comprising a handle connected to the conduit.

10. The divot repair apparatus as claimed in claim 9, wherein the handle is connected to the conduit at a distance spaced from the valve plate.

11. The divot repair apparatus as claimed in claim 9, wherein the handle includes a valve actuator for moving the valve plate from the closed position to the open position.

12. The divot repair apparatus as claimed in claim 11, wherein the handle includes an actuator biasing member for biasing the valve actuator to a starting position in which the valve plate is in the closed position.

13. The divot repair apparatus as claimed in claim 1, further comprising a smoothing tool connected to the outlet end of the conduit, the smoothing tool being adapted to manipulate the fill material after it has been dispensed.

14. A divot repair apparatus, comprising:

a hopper having a fixed shape for holding a fill material, the hopper being adapted to be removably carried on a user's back;

a conduit having a first end connected in fluid communication with the hopper, an outlet end, and a flow channel from the first end to the outlet end for dispensing the fill material from the hopper, the conduit being movable in multiple directions relative to the hopper;

a valve mechanism connected to the conduit, the valve mechanism including:

a valve plate positioned on the conduit at a spaced distance from the outlet end, the valve plate being slidable between a closed position in which the valve plate occludes the flow channel to block the flow of fill material through the conduit and an open position in which the valve plate does not occlude the flow channel, thereby enabling the fill material to flow through the conduit; and a pair of lever arms;

a valve actuator for moving the valve plate from the closed position to the open position;

a biasing member positioned at the spaced distance from the outlet end of the conduit, the biasing member being configured to bias the valve plate from the open position to the closed position;

a handle connected to the conduit; and a smoothing tool connected to the outlet end of the conduit, the smoothing tool being adapted to manipulate the fill material after it has been dispensed, wherein the pair of lever arms are interconnected between the valve actuator and the valve plate, the lever arms being pivotably connected to the conduit to convert movement of the valve actuator to a corresponding movement of the valve plate from the closed position to the open position, the conduit having a flexible portion between the hopper and the valve mechanism and a rigid portion between the valve mechanism and the outlet end.

15. The divot repair apparatus as claimed in claim 14, wherein the valve plate is positioned closer to the outlet end of the conduit than to the valve actuator.

* * * * *